US008069509B2

(12) United States Patent
Polakow

(10) Patent No.: US 8,069,509 B2
(45) Date of Patent: Dec. 6, 2011

(54) SANITARY INDICATOR

(76) Inventor: Daniel Adam Polakow, Capetown (ZA)

( * ) Notice: Subject to any disclaimer, the term of this patent is extended or adjusted under 35 U.S.C. 154(b) by 676 days.

(21) Appl. No.: 12/162,594

(22) PCT Filed: Jan. 30, 2007

(86) PCT No.: PCT/ZA2007/000012

§ 371 (c)(1),
(2), (4) Date: Jul. 29, 2008

(87) PCT Pub. No.: WO2007/090207

PCT Pub. Date: Aug. 9, 2007

(65) Prior Publication Data

US 2009/0065112 A1 Mar. 12, 2009

(30) Foreign Application Priority Data

Feb. 1, 2006 (ZA) ..... 2006/0932

(51) Int. Cl.
*A47K 17/00* (2006.01)

(52) U.S. Cl. ..... 4/661

(58) Field of Classification Search ..... 4/661, 405
See application file for complete search history.

(56) References Cited

U.S. PATENT DOCUMENTS 2,061,632 A * 11/1936 Lenher ..... 162/140
5,390,819 A * 2/1995 Kaye ..... 221/45
5,713,614 A * 2/1998 Anderson ..... 292/336.3
5,755,355 A * 5/1998 Timmerman et al. ..... 221/33
6,499,155 B1 * 12/2002 Barrios ..... 4/661
2003/0110714 A1 6/2003 Stark et al.
2006/0145469 A1 * 7/2006 Lubrino et al. ..... 283/72
2010/0239752 A1 * 9/2010 Serizawa et al. ..... 427/140

FOREIGN PATENT DOCUMENTS

DE 19910122 A1 9/2000
EP 1508647 A 2/2005
GB 2327185 A 1/1999
NL 1023249 C2 10/2004

* cited by examiner

*Primary Examiner* — Gregory Huson
*Assistant Examiner* — Karen L Younkins
(74) *Attorney, Agent, or Firm* — David J. Pitman; Fulwider Patton LLP

(57) ABSTRACT

A sanitary device 210 is provided. The sanitary device 210 includes a body and mounting means on the body for mounting the body on a toiletry actuation device 312 of a toilet 310. A stack of leaves of material is provided on the body, the leaves of material being selectively removable so as to enable a user to actuate the toiletry actuation device 312 by removing an uppermost leaf of material from the stack, to reveal a lower leaf of material, and then pressing on the lower leaf of material to actuate the toiletry actuation device 312. In this way, a user can actuate the actuation device 312 without having to touch the toiletry actuation device 312 in a manner in which the user touches a surface which has been touched previously.

11 Claims, 5 Drawing Sheets

SANITARY INDICATOR

RELATED APPLICATIONS

This is a U.S. national phase application of PCT/ZA2007/000012, filed Jan. 30, 2007, which claims priority from South African Application No. 2006/0932 filed Feb. 1, 2006.

FIELD OF THE INVENTION

THIS INVENTION relates to a sanitary device, or indicator. In particular, the invention relates to a sanitary device which can be applied to a toiletry actuation device so as to enable a user to actuate the toiletry actuation device without having to touch a surface of the toiletry actuation device which may already have been touched by another user.

BACKGROUND OF THE INVENTION

Many people are conscious of hygiene. Such people often dread using public toilet facilities because of the inherent risk of cross-contamination when touching toiletry actuation devices of such public toilet facilities.

For the purposes of this specification, the term "toiletry actuation device" is to be interpreted to include any actuation device of a type commonly found in, for example, a public toilet facility, a washroom, or the like. Such actuation devices include flushing actuators, such as buttons, and levers, and the like, for example, for actuating flushing systems of toilets, and urinals, and the like, for example, taps, or faucets, door handles, actuators of automatic hand drying mechanisms, and the like, for example.

It has been found that un-hygienic substances, such as types of pathogens, and the like, for example, often reside on different surfaces in public service areas. In the case of certain organizations in particular, such as businesses concerned with food preparation, food production, the provision of health care, and the like, as well as research institutions, hospitals, laboratories, clinics, and the like, cross-contamination of such substances should be inhibited. Methods currently employed to inhibit such cross-contamination include vigilant cleaning schedules, the addition of active substances (such as Phenol™, or Virkon™, for example) and/or passive substances (such as ethanol, for example) in cleaning agents, such as soaps, for example, the provision of operable taps which open and close without requiring the taps to be operated manually (either automatically activated or non-hand operated), and the like.

It is an object of the invention to provide a relatively simple sanitary device which can be used to inhibit cross-contamination in public toilet facilities, for example.

SUMMARY OF THE INVENTION

According to a first aspect of the invention, there is provided a sanitary device including a body, mounting means on the body for mounting the body on a toiletry actuation device and a stack of leaves of material on the body, the stack of leaves of material defining a plurality of leaves of material each of which is removable from the rest of the stack, so as to enable a user to actuate a toiletry actuation device, in use, when the body is mounted on the toiletry actuation device, by removing an uppermost leaf of material from the stack to reveal a lower leaf of material and then pressing on the lower leaf of material to actuate the toiletry actuation device.

The leaves of material of the stack may be detachably attached one to another.

The leaves of material of the stack may be detachably attached one to another by means of an adhesive.

Each of the plurality of leaves of material may be provided with a finger tab to enable the leaves of material to be removed selectively one from another by means of the finger tabs.

The sanitary device may further include indication means arranged to indicate whether or not an uppermost leaf of material has been touched previously.

The indication means may be in the form of a substance on each of the leaves of material, the substance being arranged to perform a visibly detectable change in response to being touched so as, in use, to enable a user visibly to detect whether or not an uppermost leaf of material has been touched previously.

The substance may be arranged to perform a visibly detectable change in the form of a colour change in response to being touched.

The substance may be arranged to react to contact with a user's skin.

The indication means may be defined by regions on each of the plurality of leaves of material.

Each of the leaves of material may be in the form of a paper based material.

In one embodiment, the body may be defined by a lowermost leaf of material. The mounting means may then be in the form of an adhesive on the lowermost leaf of material so as to enable the lowermost leaf of material to be mounted on the toiletry actuation device adhesively.

In another embodiment, the body may be defined by a housing arranged releasably to hold the stack of leaves of material, so that when the leaves of material of the stack are depleted, in use, the stack of leaves of material can be replenished by mounting a fresh stack of leaves of material on the housing.

The mounting means may be defined by an adhesive on the housing so as to enable the housing to be mounted on the toiletry actuation device adhesively.

The mounting means may be defined by at least one mounting formation on the housing so as to enable the housing to be mounted on the toiletry actuation by means of the mounting formation.

According to another aspect of the invention, there is provided a method of providing a sanitary device on a toiletry actuation device, the method including providing a sanitary device defining a body and a stack of leaves of material on the body and mounting the body of the sanitary device on a toiletry actuation device so that the stack of leaves of material are arranged to enable a user to actuate the toiletry actuation device by removing an uppermost leaf of material from the stack of leaves of material to reveal a lower leaf of material and then pressing on the lower leaf of material to actuate the toiletry actuation device.

Providing a sanitary device defining a body and a stack of leaves of material on the body may include providing a sanitary device in which each of the leaves of material is provided with a finger tab to enable the leaves of material to be removed selectively one from another by means of the finger tabs.

Providing a sanitary device defining a body and a stack of leaves of material on the body may include providing a sanitary device which includes indication means arranged to indicate whether or not an uppermost leaf of material has been touched previously.

Providing a sanitary device which includes indication means arranged to indicate whether or not an uppermost leaf of material has been touched previously may include providing a sanitary device which includes a substance on each of the leaves of material, the substance being arranged to perform a visibly detectable change in response to being touched so as to enable a user visibly to detect whether or not an uppermost leaf of material has been touched previously.

The sanitary device may include an adhesive layer on the body, mounting the body of the sanitary device on a toiletry actuation device then including adhesively mounting the body of the sanitary device on the toiletry actuation device.

According to another aspect of the invention, there is provided a sanitary device including a body arranged to be mounted on a toiletry actuation device and means on the body arranged to enable the toiletry actuation device to be actuated by a user without the user having to touch the toiletry actuation device in a manner in which the user touches a surface which has been touched previously.

The body may be arranged to enable a toiletry actuation device to be actuated by pressing on the body when the body is mounted on the toiletry actuation device.

The body may define a plurality of layers arranged one on top of another so as to enable the toiletry actuation device to be actuated by pressing against an exposed surface of an uppermost layer of the body. The layers may be detachably attached one to another so as to enable the uppermost layer to be removed selectively to expose a surface of a lower layer so that the toiletry actuation device can be actuated by pressing against the exposed surface of the lower layer of the body after the uppermost layer has been removed.

Each layer may be provided with a finger tab to enable the layers to be removed selectively one from another in a peel-away fashion by means of the finger tabs.

The sanitary device may further include indication means on the body arranged to indicate whether or not the body has been touched previously.

The indication means may be defined by regions on the layers arranged to perform a detectable change in response to being touched so as to enable a user to detect whether or not the body has been touched previously.

The indication means may be in the form of a substance on each surface of each layer, the substance being arranged to react to contact with a user's skin so as to indicate whether or not the body has been touched previously.

The regions on the layers may be arranged to perform a detectable change in the form of a colour change in response to being touched so as to enable a user visually to detect whether or not the body has been touched previously.

The sanitary device may include mounting means arranged to enable the body to be mounted on a toiletry actuation device.

The mounting means may be in the form of an adhesive surface of a lowermost layer so as to enable the body to be mounted on the toiletry actuation device adhesively.

Instead, the sanitary device may include a housing, or support, mountable on the toiletry actuation device, the housing, or support, being arranged to enable the body of layers to be mounted thereon so that when a last of the layers has been removed, a fresh body of layers can be mounted on the housing, or support.

BRIEF DESCRIPTION OF THE DRAWINGS

Embodiments of the invention will now be described, by way of example, with reference to the accompanying diagrammatic drawings, in which.

DETAILED DESCRIPTION OF PREFERRED EMBODIMENTS

Figure 1:
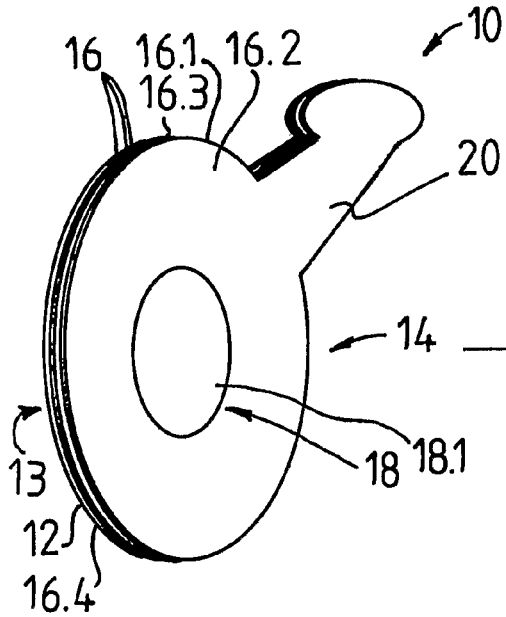
FIG. 1 shows a schematic three-dimensional view of a sanitary device in accordance with one embodiment of the invention.
Figure 2:
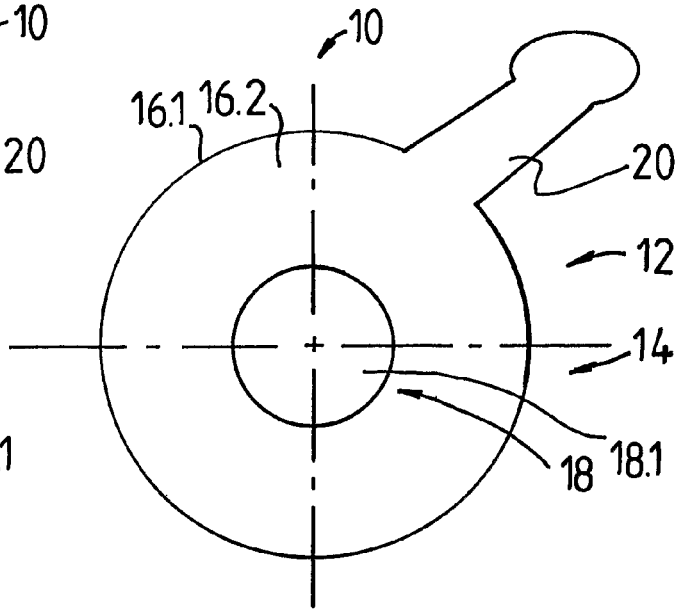
FIG. 2 shows a schematic plan view of the sanitary device of FIG. 1.

Referring to FIGS. 1 and 2 of the drawings, a sanitary device in accordance with one embodiment of the invention, is generally indicated by reference numeral 10.

The sanitary device 10 includes a body, generally indicated by reference numeral 12. The body 12 is arranged to be mounted on a toiletry actuation device in the form of, for example, a finger pressable button of the kind often employed to actuate a flushing system of a urinal, or a toilet, or the like, for example. In the embodiment shown in FIG. 1, the sanitary device 10 includes mounting means 13, in the form of an adhesive layer on the body 12, for adhesively mounting the body 12 on a toiletry actuation device.

The sanitary device 10 further includes means, generally indicated by reference numeral 14, on the body 12, arranged to enable the toiletry actuation device to be actuated by a user without the user having to touch the toiletry actuation device in a manner in which the user touches a surface which has been touched previously, as will be described in greater detail below.

The means 14 includes a plurality of layers, or a stack of leaves of material, generally indicated by reference numeral 16, on the body 12. The leaves of material 16 are arranged one on top of another so as, in use, to enable a toiletry actuation device to be actuated by pressing against an uppermost leaf, or layer 16.1, or an exposed surface 16.2 of an uppermost leaf, or layer 16.1. The leaves 16 are detachably attached one to another so as to enable the uppermost leaf 16.1 to be removed to expose a surface of a lower leaf 16.3 so that the toiletry actuation device can be actuated by pressing against the exposed surface of the lower leaf 16.3 after the uppermost leaf 16.1 has been removed.

Advantageously, each leaf 16 is provided with a finger tab 20 to enable the leaves 16 to be removed selectively one from another in a peel-away fashion by means of the finger tabs 20.

Typically, the sanitary device 10 further includes indication means, generally indicated by reference numeral 18, on the leaves 16. The indication means 18 is arranged to indicate whether or not the surface of an uppermost leaf 16, has been touched previously. The indication means 18 is defined by regions 18.1 on the leaves 16, which regions 18.1 are arranged to perform a detectable change in response to being touched so as to enable a user to detect whether or not the surface of an uppermost leaf 16 has been touched previously. Typically, the indication means 18 is in the form of a substance on the leaves, or surfaces of each layer 16. The substance is arranged to react to contact with a user's skin so as to indicate whether or not an uppermost leaf 16 has been touched previously. Advantageously, the regions 18.1 on the leaves 16 are arranged to perform a detectable change in the form of a colour change in response to being touched so as to enable a user to detect whether or not an uppermost leaf 16 has been touched previously. Accordingly, the regions 18.1 can react in a fashion similar to litmus paper, for example. It will be appreciated that the regions 18.1 need not be limited to distinct regions on the leaves 16. Instead, the leaves 16 themselves can be inherently of a form arranged to react when touched anywhere thereon.

In one embodiment, the indication means 18 includes a transparent adhesive layer. The transparent adhesive layer can include a transparent celluloid, or polyethylene layer, or the like, for example. When such adhesive layer is then touched, the adhesive layer strips off one or more small disposable elements of skin, typically loose skin cells, such as keratin, or the like, for example, and/or skin oils, and/or sweat, and/or dirt, or the like, for example, to render the layer partially opaque, or smudged, or blemished, or the like. In this way, a user can be provided with a visible indication of whether or not an uppermost leaf of material of the stack 16 has been touched previously.

To enhance the visible indication, a dilute amount of sudan black, or crystal violet, or graphite, or a coloured powder, can be applied to the adhesive layer. In this way, a smudge resulting from being touched can be rendered more clearly visible upon reacting with amino acids of the skin, for example.

In another embodiment of the invention, the leaves of material 16 can be paper based, or the like, for example, and the leaves of material 16 are impregnated with the indication means 18. The indication means 18 can then include a substance, or chemical, arranged to react with a person's skin. The indication means 18 can be arranged to react with amino acids, or the like, for example, on a person's skin. Such a substance can be 5-MTN, or the like, for example. The substance can be derived from a working solution of 15% 5-MTN. Additional constituents of such a working solution can be 10 ml of ascetic acid, 25 ml of isopropanol, 145 ml of ethyl acetate, 100 ml of MTBE (methyl-tert-butylether), and 720 ml of petroleum ether, or the like, for example. The leaves of material 16 can then be impregnated with the working solution until the solvents have evaporated. Typically, such an indication means 18 discolours purple when touched by skin.

It is envisaged that the indication means 18 can include a non-toxic substance, or chemical, or the like, which reacts to contact with human skin. The substance can be arranged to react to contact with amino-acids, natural oils found on the skin, moisture, or any other appropriate substance found on the skin, or the like, for example. Typically, the substance can be relatively pressure insensitive and temperature insensitive. The substance can be arranged to impregnate the leaves 16, or clearly marked regions 18.1, of the leaves 16.

The sanitary device 10 includes mounting means arranged to enable the body 12 to be mounted on a toiletry actuation device. In the embodiment of FIGS. 1 and 2, the body 12 is in the form of a lowermost layer, or leaf 16.4, and the mounting means 13 is in the form of an adhesive rear surface, or layer on the lowermost layer, or leaf 16.4, so as to enable the body 12 to be mounted on the toiletry actuation device adhesively. In other embodiments, as will be described in greater detail below, the body can be in the form of a housing, or support, mountable on the toiletry actuation device. The housing, or support, can be arranged to enable a fresh stack of leaves of material to be mounted thereon so that when a last of the leaves of the stack of leaves of material has been removed, a fresh stack of leaves, or a refill, can be mounted on the housing, or the support. Advantageously, the mounting means can then be on the housing or the support. The housing, or the support, can then be of a shape arranged to straddle the toiletry actuation device to which it is to be applied.

Figure 3:
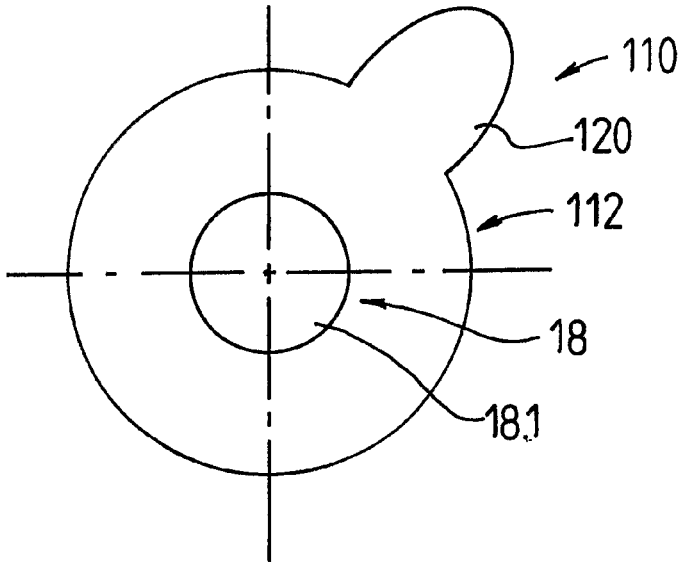
FIG. 3 shows a schematic plan view of another sanitary device in accordance with another embodiment of the invention.

Referring to FIG. 3 of the drawings, in which like reference numerals have been used to designate similar parts, or features, unless otherwise stated, another sanitary device in accordance with another embodiment of the invention, is generally indicated by reference numeral 110. The sanitary device 110 is similar to the sanitary device 10, save that the finger tab 120 of the sanitary device 110 is of a different shape.

Figure 4:
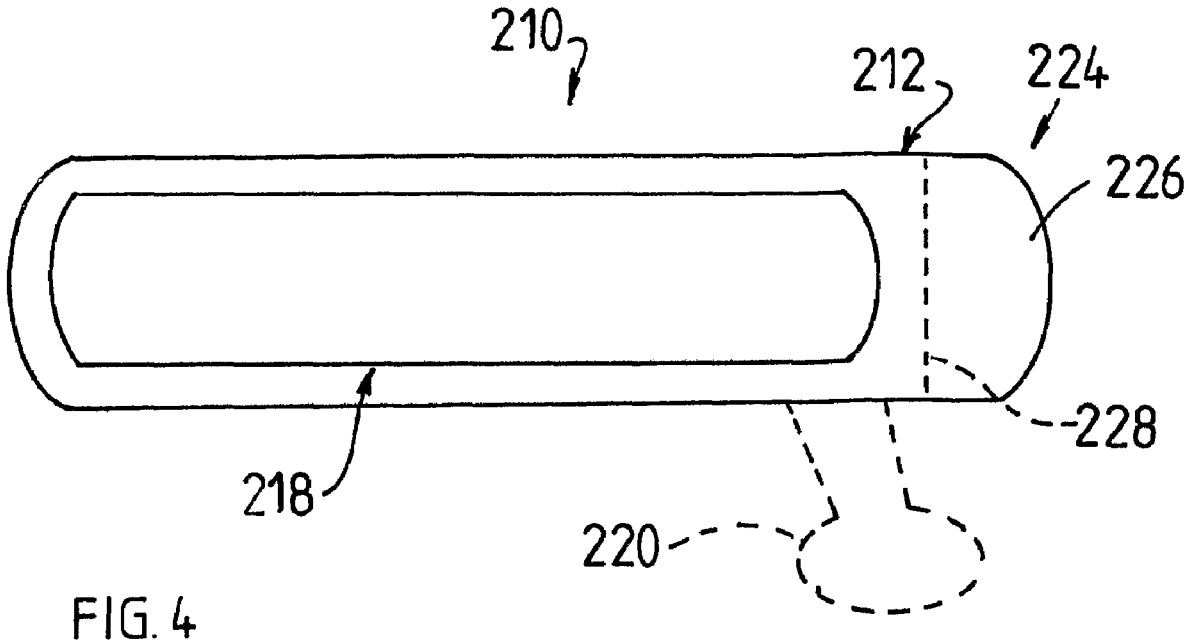
FIG. 4 shows a schematic plan view of yet another sanitary device in accordance with another embodiment of the invention.

Referring now to FIG. 4 of the drawings, in which like reference numerals have been used to designate similar parts, or features, unless otherwise stated, another sanitary device in accordance with another embodiment of the invention, is generally indicated by reference numeral 210. It will be appreciated that the sanitary device 210 functions in a fashion generally similar to that of the sanitary device 10. The sanitary device 210 defines a body and a stack of leaves of material 212 having a shape different to that of the body 12 and stack of leaves of material 16 of the sanitary device 10. The body and the stack of leaves of material 212 is of a shape arranged to be mounted on a toiletry actuation device in the form of, for example, a pressable lever of the kind often employed to actuate a flushing system of a toilet, a door handle of a toilet cubicle, a door handle of a door leading from a toiletry facility, or the like. Accordingly, the body and the stack of leaves of material 212 are elongate.

Each of the leaves of material of the sanitary device 210 can define a finger tab 220, as indicated in dashed lines. Instead, or in addition, an end region 224 of the sanitary device 210 can be provided in which leaves of material of the sanitary device 210 are free of one another to define finger tabs at 226, as indicated to the right of the dashed line 228.

It will be appreciated that the sanitary device of the invention can be of any appropriate shape depending on the shape and area of normal contact of a toiletry actuation device to which it is to be applied. It will further be appreciated that the invention extends to a sanitary device similar to those described above, but having a shape arranged to be applied to a tap, or a faucet, to an actuation device of a hand drier, or the like, for example.

Figure 5:
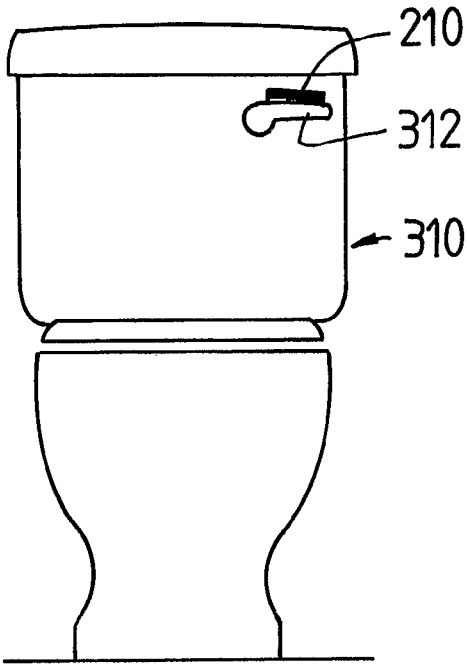
FIG. 5 shows a schematic frontal view of a toilet having a sanitary device, similar to the sanitary device shown in FIG. 4, mounted on an actuation device of the toilet.

Referring to FIG. 5 of the drawings, in which like reference numerals have been used to designate similar parts, or features, unless otherwise stated, the sanitary device 210 is shown in an operative condition mounted on a toiletry actuation device 312 of a toilet 310. The toiletry actuation device 312 is in the form of an actuation lever for selectively actuating a flushing system of the toilet 310.

Figure 6:
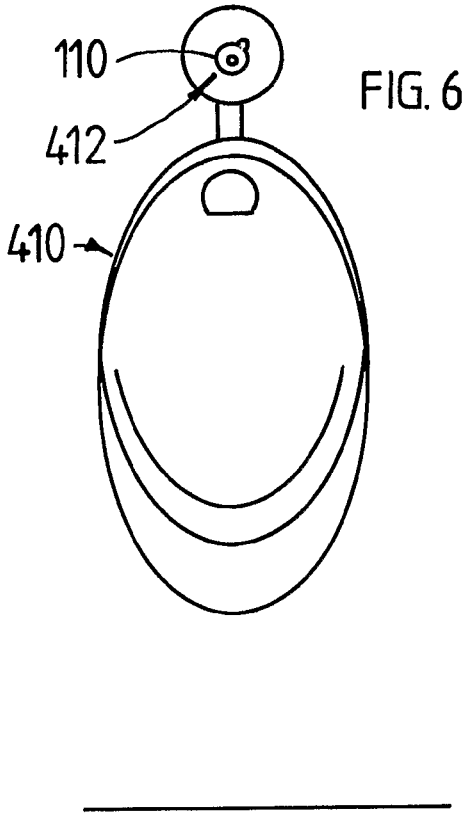
FIG. 6 shows a schematic frontal view of a urinal having a sanitary device, similar to the sanitary device shown in FIG. 3, mounted on an actuation device of the urinal.

Referring to FIG. 6 of the drawings, in which like reference numerals have been used to designate similar parts, or features, unless otherwise stated, the sanitary device 110 is shown in an operative condition mounted on a toiletry actuation device 412 of a urinal 410. The toiletry actuation device 412 is in the form of an actuation button for selectively actuating a flushing system of the urinal 410.

Figure 7:
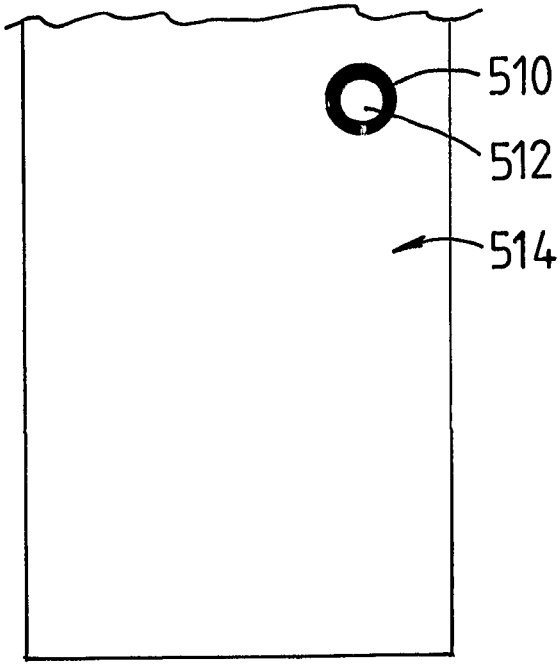
FIG. 7 shows a schematic frontal view of a door leading from a toilet facility, the door having a sanitary device, similar to the sanitary device shown in FIG. 4, mounted on an actuation device in the form of a door knob of the door.

Referring to FIG. 7 of the drawings, in which like reference numerals have been used to designate similar parts, or features, unless otherwise stated, a sanitary device 510, similar to the sanitary device 210, is shown in an operative condition mounted on a toiletry actuation device 512 of a door 514. The toiletry actuation device 512 is in the form of an actuation knob for selectively actuating a locking mechanism of the door 514, so as to open the door 514. The door 514 can be a door of a cubicle in an ablution block, or a toiletry facility, or can be in the form of a door leading from the ablution block, or a toiletry facility, or the like, for example. Typically, the sanitary device 510 is similar to the sanitary device 210, save that the sanitary device 510 has a greater length so as to extend over a relatively large portion of an area of the knob 512 which is normally touched by a user when the knob 512 is actuated, in use.

Figure 8:
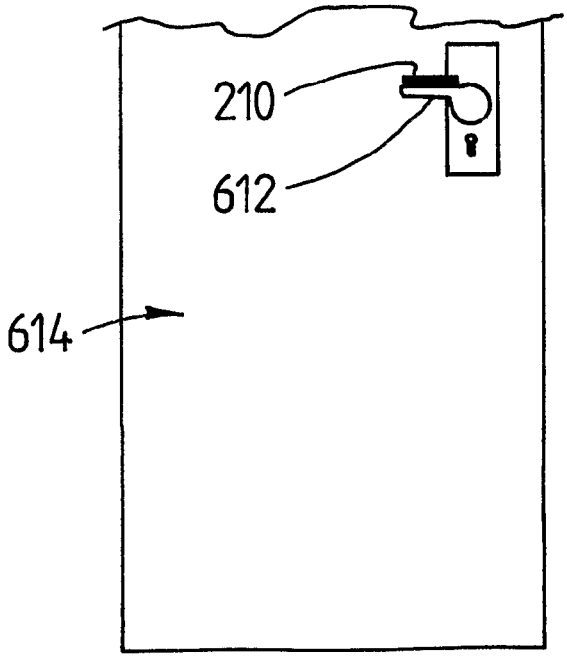
FIG. 8 shows a schematic frontal view of a door leading from a toilet facility, the door having a sanitary device, similar to the sanitary device shown in FIG. 4, mounted on an actuation device in the form of a door handle of the door.

Referring to FIG. 8 of the drawings, in which like reference numerals have been used to designate similar parts, or features, unless otherwise stated, the sanitary device 210 is shown in an operative condition mounted on a toiletry actuation device 612 of a door 614. The toiletry actuation device 612 is in the form of an actuation handle, or lever, for selectively actuating a locking mechanism of the door 614, so as to open the door 614.

In use, a sanitary device 10, 110, 210, 510 is mounted on an associated toiletry actuation device by adhesively securing the sanitary device 10, 110, 210, 510 on the toiletry actuation device. When a user then wishes to actuate the toiletry actuation device, the user can then remove an uppermost leaf from the rest of the sanitary device 10, 110, 210, 510, so as to expose a surface of a lower leaf, which has not been touched previously. The leaves are typically disposable so that once an uppermost leaf has been removed, it is typically discarded. The user can then actuate the toiletry actuation device by pressing against the freshly exposed surface of the lower leaf. In this way, a user can actuate a toiletry actuation device in a manner in which the user does not touch a surface which has been touched previously. Advantageously, the user can detect whether or not the toiletry actuation device has been previously actuated by examining the indication means 18, 218. If the indication means 18, 218 reveals that the surface of an uppermost leaf on the body 12, 112, 212 has not been touched previously, the user need not remove the uppermost leaf to enable the user to actuate the toiletry actuation device without having to touch a surface which has been touched previously. In this way, cross contamination by actuation of toiletry actuation devices can at least be alleviated.

Figure 9:
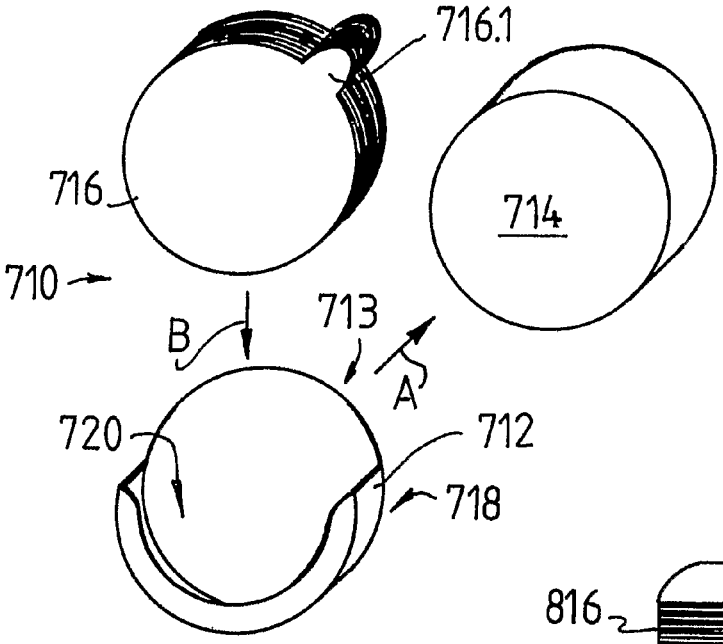
FIG. 9 shows a schematic three-dimensional view of a sanitary device, in accordance with another embodiment of the invention, being mounted on a toiletry actuation device in the form of an actuation button.

With reference to FIG. 9 of the drawings, in which like reference numerals have been used to designate similar parts, or features, unless otherwise stated, another sanitary device in accordance with another embodiment of the invention is generally indicated by reference numeral 710.

The sanitary device 710 includes a body 712 and a stack of leaves of material 716. The body 712 defines a rear surface 713. The rear surface 713 has mounting means 718 for mounting the body 712 on a toiletry actuation device in the form of an actuation button 714. The actuation button 714 can be a button arranged to actuate a flushing system of a toilet, or a urinal, or the like, for example. The mounting means 718 is in the form of an adhesive layer arranged to enable the body 712 to be adhesively mounted against the actuation button 714, as indicated by arrow A.

The body 712 is in the form of a housing arranged to hold the stack of leaves of material, as indicated by arrow B. To this end, the body 712 defines a holding compartment 720.

The stack of leaves of material 716 defines a plurality of leaves of material. In one embodiment, each leaf of material defines indication means similar to the indication means 18 as described above. In another embodiment, indication means is absent on the leaves of material. The leaves of material can be loose from each other. Instead, the leaves of material can be detachably attached one to another by means of an adhesive arranged to enable a user selectively to detach one leaf from another in a peel-away fashion. Advantageously, each leaf of material of the stack of leaves of material 716 defines a finger tab 716.1 to enable a user selectively to remove an uppermost leaf of material from the stack of leaves of material 716 by gripping a finger tab 716.1 of the uppermost leaf of material.

It will be appreciated that, in use, when the body 712 is mounted on the actuation button 714 and the stack of leaves of material 716 is held in the compartment 720 of the body 712, a user can actuate the actuation button 714 by removing an uppermost leaf of material from the stack 716 and the compartment 720 to reveal a lower leaf of material and then pressing on the lower leaf of material to actuate the toiletry actuation device 714. In this way, the actuation button 714 can be actuated without the user having to touch a surface which has been touched previously.

Figure 10:
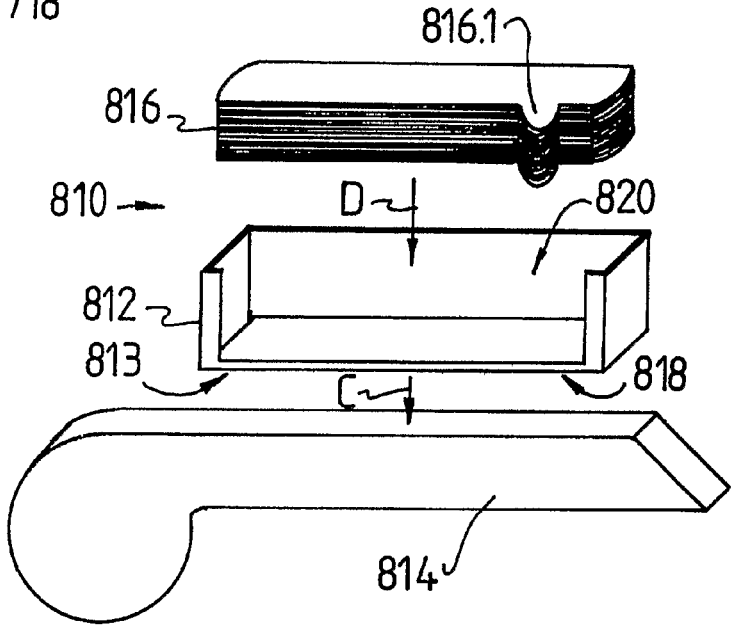
FIG. 10 shows a schematic three-dimensional view of a sanitary device, in accordance with another embodiment of the invention, being mounted on a toiletry actuation device in the form of an actuation lever.

With reference to FIG. 10 of the drawings, in which like reference numerals have been used to designate similar parts, or features, unless otherwise stated, another sanitary device in accordance with another embodiment of the invention is generally indicated by reference numeral 810.

The sanitary device 810 includes a body 812 and a stack of leaves of material 816. The body 812 defines a rear surface 813. The rear surface 813 has mounting means 818 for mounting the body 812 on a toiletry actuation device in the form of an actuation handle, or lever 814. The actuation lever 814 can be a lever arranged to actuate a flushing system of a toilet, or a urinal, a handle, or lever, of a door of a cubicle in an ablution block, a handle of a door leading from an ablution block, or the like, for example. The mounting means 818 is in the form of an adhesive layer arranged to enable the body 812 to be adhesively mounted on the actuation lever 814, as indicated by arrow C.

The body 812 is in the form of a housing arranged to hold the stack of leaves of material 816, as indicated by arrow D. To this end, the body 812 defines a holding compartment 820.

The stack of leaves of material 816 defines a plurality of leaves of material. In one embodiment, each leaf of material defines indication means similar to the indication means 218 as described above. In another embodiment, indication means is absent on the leaves of material. The leaves of material can be loose from each other. Instead, the leaves of material can be detachably attached one to another by means of an adhesive arranged to enable a user selectively to detach one leaf from another in a peel-away fashion. Advantageously, each leaf of material of the stack of leaves of material 816 defines a finger tab 816.1 to enable a user selectively to remove an uppermost leaf of material from the stack of leaves of material 816 by gripping a finger tab 816.1 of the uppermost leaf of material.

It will be appreciated that, in use, when the body 812 is mounted on the actuation lever 814 and the stack of leaves of material 816 is held in the compartment 820 of the body 812, a user can actuate the actuation lever 814 by removing an uppermost leaf of material from the stack 816 and the compartment 820 to reveal a lower leaf of material and then pressing on the lower leaf of material to actuate the toiletry actuation device. In this way, the actuation lever 814 can be actuated without the user having to touch a surface which has been touched previously.

Figure 11:
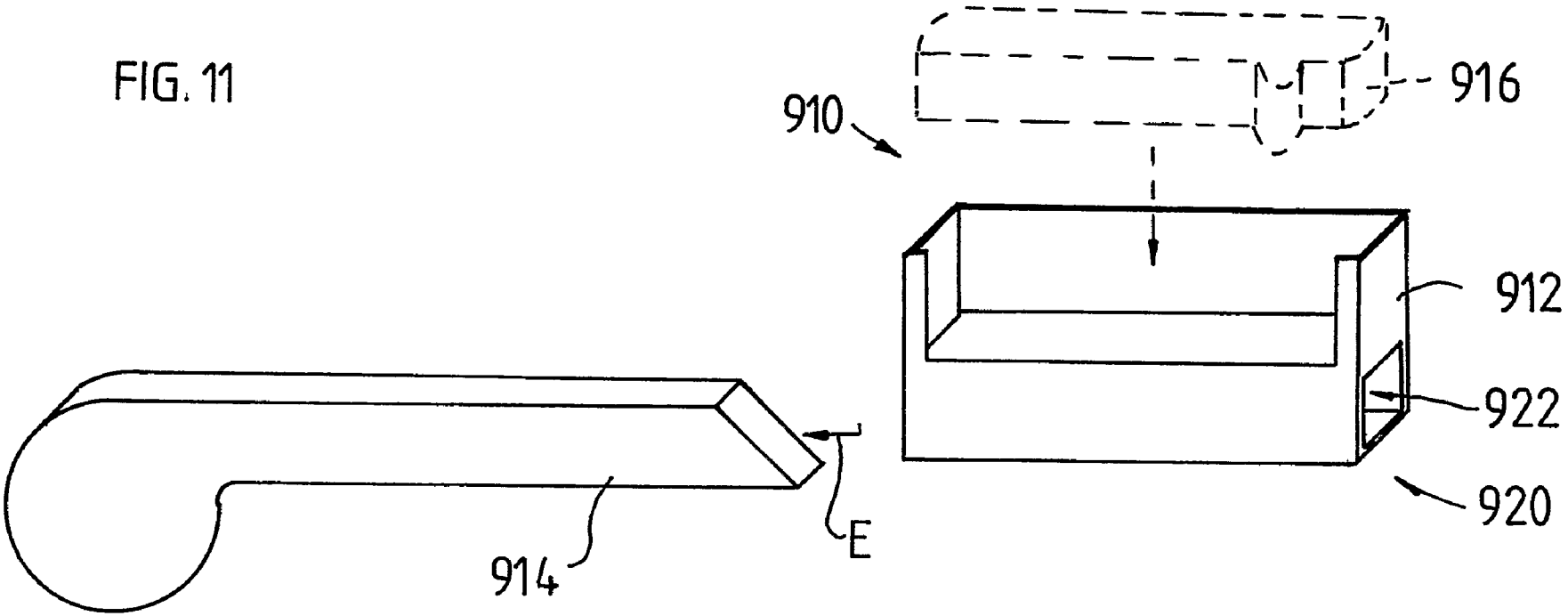
FIG. 11 shows a schematic three-dimensional view of a sanitary device, in accordance with yet another embodiment of the invention, being mounted on a toiletry actuation device in the form of an actuation lever.

With reference to FIG. 11 of the drawings, in which like reference numerals have been used to designate similar parts, or features, unless otherwise stated, another sanitary device in accordance with another embodiment of the invention is generally indicated by reference numeral 910.

The sanitary device 910 includes a body 912 and a stack of leaves of material 916. The body 912 is similar to the body 812 of the sanitary device 810 save that the body 912 defines mounting means in the form of a mounting formation 920, instead of an adhesive layer on a rear surface thereof. The mounting formation 920 defines a passage 922 arranged to receive a toiletry actuation device in the form of an actuation handle, or lever 914, therein, as indicated by arrow E. The actuation lever 914 can be a lever arranged to actuate a flushing system of a toilet, or a urinal, a handle, or lever, of a door of a cubicle in an ablution block, a handle of a door leading from an ablution block, or the like, for example. Appropriate fasteners, such as screw-threaded fasteners, or the like, for example, can be employed releasably to retain the lever 914 in the passage 922, when received therein. It will be appreciated that the stack of leaves of material 916 is similar to the stack of leaves of material 816.

In the embodiments of the sanitary device as shown and described with reference to FIGS. 9, 10 and 11 of the drawings, the stacks of leaves of material can be replenished with fresh stacks of leaves of material when the stacks of leaves of material have been used up.

In one embodiment of the invention, the leaves of material mentioned above, are of a paper based material. However, it will be appreciated that any appropriate material can be used instead, such as layers of a plastics material, or the like, for example It is believed that the sanitary device of the invention provides a relatively inexpensive means for providing a "usage barrier" to at least inhibit cross-contamination. Conveniently, the sanitary device is arranged to indicate whether the toiletry actuation device to which it is applied has been previously touched. By removing an uppermost leaf, or layer, a user can actuate the toiletry actuation device without having to touch the toiletry actuation device itself.

The invention claimed is:

1. A sanitary device for mounting on a toiletry activation device including:

a body;

mounting means on the body for mounting the body on a toiletry actuation device;

a stack of leaves of material on the body, the stack of leaves of material defining a plurality of leaves of material each of which is removable from the rest of the stack, so as to enable a user to actuate a toiletry actuation device, in use, when the body is mounted on the toiletry actuation device, by removing an uppermost leaf of material from the stack to reveal a lower leaf of material and then pressing on the lower leaf of material to actuate the toiletry actuation device; and an indication means applied to an upper surface of each leaf in the stack, the indication means being a substance adapted to react with particles on the skin of a user of the activation device, whereby the indication means indicates whether or not an uppermost leaf has been touched previously.

2. The sanitary device as claimed in claim 1, in which the leaves of material of the stack are detachably attached one to another.

3. The sanitary device as claimed in claim 2, in which the leaves of material of the stack are detachably attached one to another by means of an adhesive.

4. The sanitary device as claimed in claim 2, in which each of the plurality of leaves of material is provided with a finger tab to enable the leaves of material to be removed selectively one from another by means of the finger tabs.

5. The sanitary device as claimed in claim 1, in which the body is defined by a lowermost leaf of material and the mounting means is in the form of an adhesive on the lowermost leaf of material so as to enable the lowermost leaf of material to be mounted on the toiletry actuation device adhesively.

6. The sanitary device as claimed in claim 1, in which the body is defined by a housing arranged releasably to hold the stack of leaves of material, so that when the leaves of material of the stack are depleted, in use, the stack of leaves of material can be replenished by mounting a fresh stack of leaves of material on the housing.

7. The sanitary device as claimed in claim 6, in which the mounting means is defined by an adhesive on the housing so as to enable the housing to be mounted on the toiletry actuation device adhesively.

8. The sanitary device as claimed in claim 6, in which the mounting means is defined by at least one mounting formation on the housing so as to enable the housing to be mounted on the toiletry actuation by means of the mounting formation.

9. The sanitary device as claimed in claim 1, wherein the indication means includes an adhesive layer, whereby when the adhesive layer is touched the adhesive layer removes particles from the user's skin to leave a visible smudge.

10. The sanitary device as claimed in claim 9, wherein the indication means further includes a chemical substance selected from at least one of sudan black, crystal violet, and graphite.

11. The sanitary device as claimed in claim 1, wherein the leaves are formed from paper, and the indication means includes 5-MTN which is impregnated in the paper.

* * * * *